US006329975B1

(12) United States Patent
Yamaguchi

(10) Patent No.: US 6,329,975 B1
(45) **Date of Patent: *Dec. 11, 2001**

(54) LIQUID-CRYSTAL DISPLAY DEVICE WITH IMPROVED INTERFACE CONTROL

(75) Inventor: Hisashi Yamaguchi, Tokyo (JP)

(73) Assignee: NEC Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/816,525

(22) Filed: Mar. 13, 1997

(30) Foreign Application Priority Data

Mar. 22, 1996 (JP) ..... 8-066400

(51) Int. Cl.[7] ..... G09G 3/36
(52) U.S. Cl. ..... 345/99; 345/213; 345/212
(58) Field of Search ..... 345/87, 94, 97, 345/98, 99, 204, 212, 213

(56) References Cited

U.S. PATENT DOCUMENTS 4,701,026 * 10/1987 Yazaki et al. ..... 345/97
5,313,222 * 5/1994 Lee ..... 345/99
5,434,589 * 7/1995 Nakamura et al. ..... 345/98
5,729,246 * 3/1998 Masuko ..... 345/98
5,731,798 * 3/1998 Shin ..... 345/99
5,828,368 * 10/1998 Jung ..... 345/213
5,861,862 * 1/1999 Akiyama ..... 345/96

* cited by examiner

*Primary Examiner*—Almis R. Jankus
*Assistant Examiner*—Amr Awad
(74) *Attorney, Agent, or Firm*—McGuireWoods LLP

(57) ABSTRACT

A liquid crystal display device comprising a start pulse generation circuit which gives the timing for displaying a received image in a fixed position on a liquid crystal display panel, another start pulse generating circuit which gives the timing for displaying the received image in a specified position on the liquid crystal display panel in response to enable signal indicating an effective display data period concerning the received image from the outside, and selectors which select one of these circuits in response to a select signal. The liquid crystal display device according to this present invention has a data enable signal detection circuit which detects the data enable signal and outputs the result to the selectors as the select signal.

8 Claims, 6 Drawing Sheets

LIQUID-CRYSTAL DISPLAY DEVICE WITH IMPROVED INTERFACE CONTROL

BACKGROUND OF THE INVENTION

The present invention relates to a liquid crystal display device, and more particularly to an active matrix liquid crystal display including a plurality of pixels each having a switching element each.

FIG. 1 shows the following configuration of a conventional active matrix liquid crystal display device (AM-LCD). This AM-LCD displays images by receiving the signals: a vertical synchronizing signal $V_{sync}$, a horizontal synchronizing signal $H_{sync}$, a dot clock, and picture signals. These signals come from a personal computer or the like.

A liquid crystal display panel 1 includes thin film transistors (TFTS) 12, liquid crystal capacitors 13, storage capacitors 14 for improving the quality of displayed images, and gate lines 15, and source lines 16. A gate line 15 is connected to the gate electrodes of the TFTs for supplying a scanning signal to the transistors. A source line 16 is connected to the source electrodes of the TFTs for supplying a signal voltage to the TFTS. The gate lines 15 are connected to a gate driver 2, and the source lines 16 to a source driver 3.

The AM-LCD receives the vertical synchronizing signal $V_{sync}$, the horizontal synchronizing signal $H_{sync}$, the dot clock and the picture signals (display data) synchronized with the dot clock, thereby displaying images on the display panel 1. Specifically, display data corresponding to one horizontal line are stored in the source driver 3 during one horizontal synchronizing period. The stored display data corresponding to one horizontal line are outputted all at once to the source lines of the liquid crystal display panel 1 during the next horizontal synchronizing period. As a scanning signal is inputted to a gate line at the same time, the TFTs on the gate line are turned on and supply electric charges corresponding to the display data to the liquid crystal capacitors. This operation is carryed out for each gate line, and a whole image can be displayed on the display panel.

The functions of the control sections for signals given to the gate driver 2 and the source driver 3 will be described next.

A register 4 holds in advance a value as the counted number of horizontal synchronizing signal pulses corresponding to the period from the switching timing of the vertical synchronizing signal to the starting timing of an effective display data period. A register 5 holds in advance a value as the counted number of dot clock pulses corresponding to the period from the switching timing of the horizontal synchronizing signal to the starting timing of an effective display data period.

A start pulse generation circuit 6 generates a gate start pulse signal and a source start pulse signal for giving start timings to the gate driver 2 and the source driver 3 respectively, on the basis of the signal $V_{sync}$, the signal $H_{sync}$, the dot clock and the values held in the respective registers 4 and 5. The gate start pulse signal and the source start pulse signal from the start pulse generating circuit 6 determine a display area on the liquid crystal display panel 1.

On the other hand, a start pulse generation circuit 7 generates a gate start pulse signal and a source start pulse signal for giving start timings for the gate driver 2 and the source driver 3 respectively, on the basis of a data enable signal indicating effective display data periods comming from an computer and the signal $V_{sync}$. The gate start pulse signal and the source start pulse signal from the start pulse generating circuit 7 determine a display area on the liquid crystal display panel 1. Thus the start pulse generating circuit 7 enables the AM-LCD to control the display area from the outside as far as the horizontal direction is concerned.

The gate start pulse signal generated by the start pulse generation circuits 6 or 7 is inputted to the gate driver 2 through a selector 9, and the source start pulse signal generated by the circuits 6 or 7 is inputted to the source driver 3 through a selector 8. Each of the selectors 8 and 9 selects these start pulse signals in response to a select signal from a computer.

A circuit 10 converts picture signals (display data) into A.C. signals in a specified a frequency (for example, 50 or 60 Hz) and sends them to the source driver 3.

There are two modes for displaying images; one is the display fixing mode, in which the display area is fixed on a specified position, and the other is the display control mode, in which the display area can be controlled by signals from the outside. The operations according to these display modes will now be described as follows.

(1) Display Fixing Mode

FIG. 2A shows a timing chart for describing the operation of this mode. Referring to the register 4 holding the value, the start pulse generation circuit 6 counts the pulses of the signal $H_{sync}$, with the switching timing of the signal $V_{sync}$ as a starting point, and generates a gate start pulse signal $V_{sp1}$ on the completion of counting up to the value. In other words, the gate start pulse signal $V_{sp1}$ is generated after a lapse of a specified length of time $V_{bp}$ (shown in FIG. 2A) from the switching timing of the signal $V_{sync}$.

Besides, referring to the register 5 holding the value, the start pulse generation circuit 6 counts the pulses of the dot clock pulses (not shown) with the switching timing of the signal $H_{sync}$ as a starting point and generates the source start pulse signal $H_{sp1}$ on the completion of counting up to the value. In other words, the source start pulse signal $H_{sp1}$ is generated after a lapse of a specified length $H_{bp}$ (shown in FIG. 2A) from the switching timing of the signal $H_{sync}$.

While a select signal that indicates the display fixing mode is being inputted to the selectors from a computer, the signal $V_{sp1}$ and the signal $H_{sp1}$ that are generated by the start pulse generating circuit 6 are selected by the selectors 8 and 9, and being inputted to the gate driver 2 and the source driver 3.

The source driver 3 starts to output the stored display data A, B, C, D, E, . . . to the source lines in synchronism with the $H_{sp1}$ on receiving the signal $V_{sp1}$. At the same time, the gate driver 2 starts to output scanning signals $G_1$, $G_2$, $G_3$, $G_4$, . . . sequentially to the gate lines in synchronism with the $H_{sp1}$. As a result, a whole image including the display data A, B, C, D, E, . . . can be displayed in a specified position on the liquid crystal display panel 1.

(2) Display Control Mode

A data enable signal indicating effective display data periods keeps an enable level during an effective display data period, and keeps a disable level during an invalid display data period. As shown in FIG. 2B, a source start pulse signal $H_{sp2}$ is generated at the timing when the data enable signal goes to the enable level. Besides, a gate start pulse signal $V_{sp2}$ is generated at the timing when the data enable signal goes to the enable level after the first pulse of the signal $H_{sp2}$.

While the select signal indicating the display control mode is being inputted to the selectors from a computer, the signal $V_{sp2}$ and the signal $H_{sp2}$ that are generated by the start pulse generating circuit 7 are selected by the selectors 8 and 9 and being inputted to the gate driver 2 and the source driver 3, respectively.

The source driver 3 starts to output the stored display data A, B, C, D, E, . . . to the source lines in synchronism with the signal $H_{sp2}$ on receiving the signal $V_{sp2}$. At the same time, the gate drives 2 starts to output the scanning signals $G_1$, $G_2$, $G_3$, $G_4$, . . . sequentially to the gate lines in synchronism with the signal $H_{sp2}$. As a result, a whole image including the display data A, B, C, D, E, . . . , can be displayed in a desired position on the liquid crystal display panel 1.

Thus, two interface signals, namely, the data enable signal and the select signal are necessary for the display control mode in addition to the five signals: the signal $V_{sync}$, the signal $H_{sync}$, and the analog picture signals R, G and B. Therefore, the conventional AM-LCDs require seven signals each. In view of simplifying the interface of the liquid crystal display device, the input number is larger than that of a CRT, which requires five interface signals: the signal $V_{sync}$, the signal $H_{sync}$, and the analog picture signals R, G, and B. Accordingly, it is a important issue to reduce the number of the interface signals in the AM-LCDs.

SUMMARY OF THE INVENTION

It is an object of this invention to provide a liquid crystal display device which can achieve a simple interface.

A liquid crystal display device comprising a selector and a data enable signal detection circuit, the selector having a function of selecting display modes in response to a select signal, and the data enable signal circuit generating the select signal in response to a data enable signal indicating effective display data periods from the outside.

In the above case, the selector may be provided so as to select the first display mode in case the select signal is inactive and select the second display mode in case it is active, and the data enable signal detection circuit generating the select signal set to be inactive when the data enable signal indicating an effective data period is not detected for a specified length of time and the select signal to be active when the data enable signal indicating an effective data period is detected within the period.

Moreover, the data enable signal detection circuit may comprise a D flip-flop which inputs the vertical synchronizing signal concerning the received image from the outside to its clock input terminal, the data enable signal to its data input terminal, holding the signal level of the data enable signal at the rise timing of the vertical synchronizing signal, and outputting the held level.

Furthermore, the data enable signal detection circuit may comprise a one-shot multivibrator which has a circuit including a resistor and a capacitor with a time constant longer than the cycle of the vertical synchronizing signal pulses concerning the received image from the outside, inputting the data enable signal, outputs a signal to be inactive when the data enable signal indicating an effective display data period is not received for a length of time longer than the cycle of the vertical synchronizing signal pulses, and outputs a signal to be inactive signal when the data enable signal indicating an effective display data period is received during the cycle.

According to this invention, the select signal for selecting one of the two modes is generated on the basis of the data enable signal indicating effective display data periods concerning the display data. Consequently, the interface of the AM-LCD can be simplified because the select signal from the outside is unnecessary.

BRIEF DESCRIPTION OF THE DRAWINGS

The above and other objects, features and advantages of the present invention will be more apparent from the following description taken in conjunction with the accompanying drawings, in which.

DETAILED DESCRIPTION OF THE PREFERRED EMBODIMENTS

Figure 1:
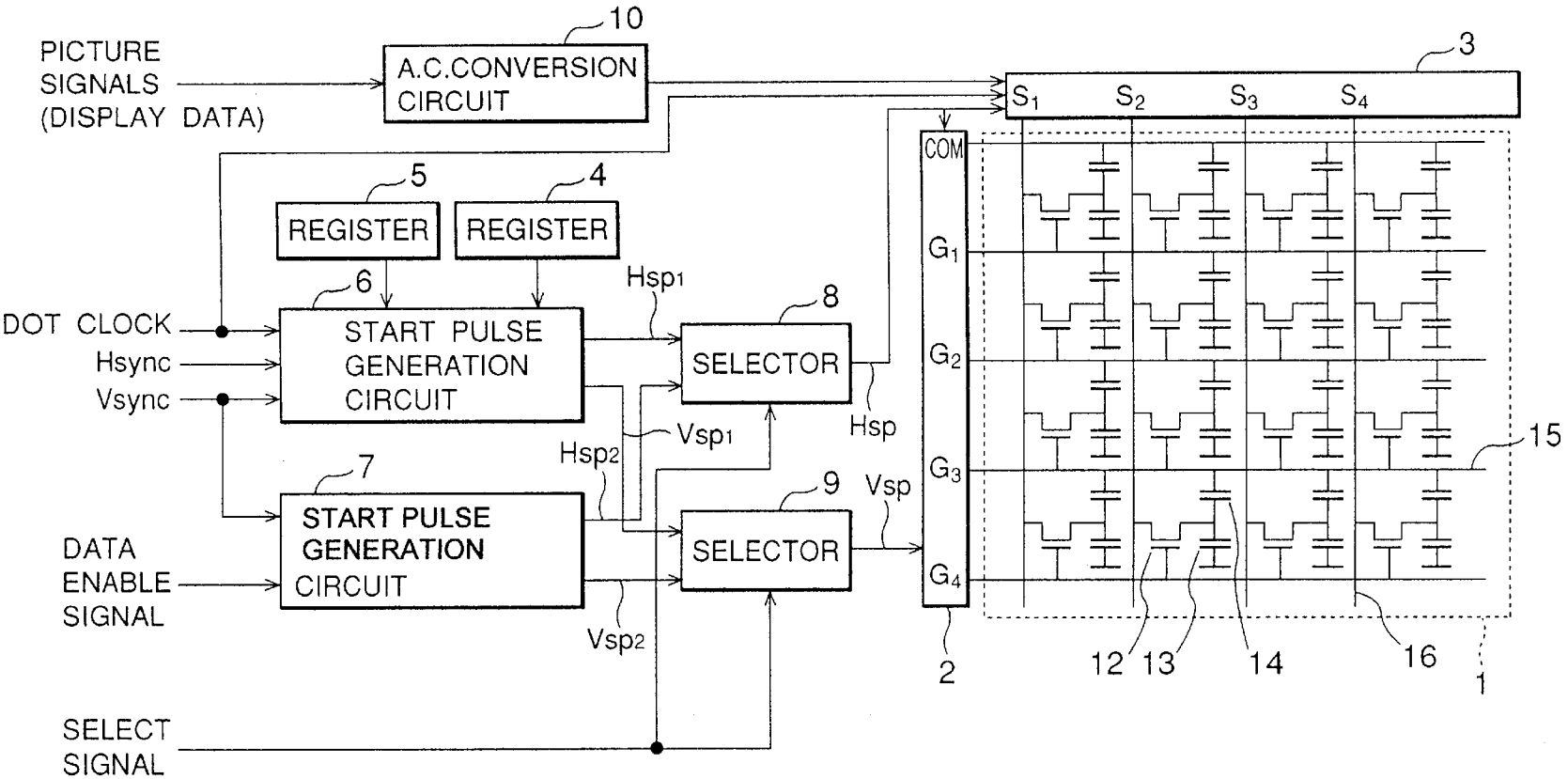
FIG.1 PRIOR ART
FIG. 1 is a block diagram showing the configuration of a conventional active matrix liquid crystal display device.
Figure 2A:
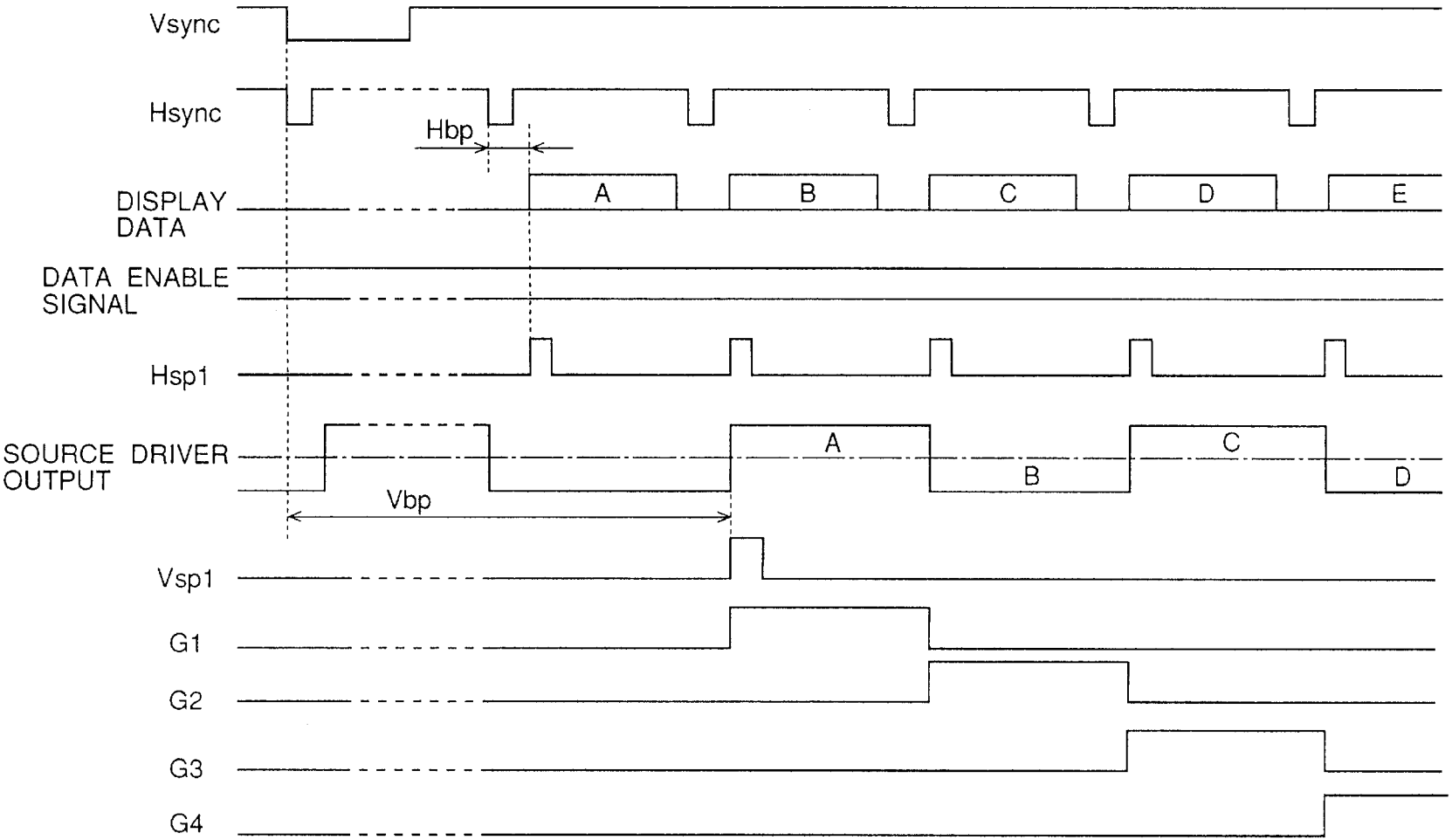
FIG.2A PRIOR ART
FIG. 2A is a timing chart for describing the operation of the display fixing mode of the active matrix liquid crystal display device.
Figure 2B:
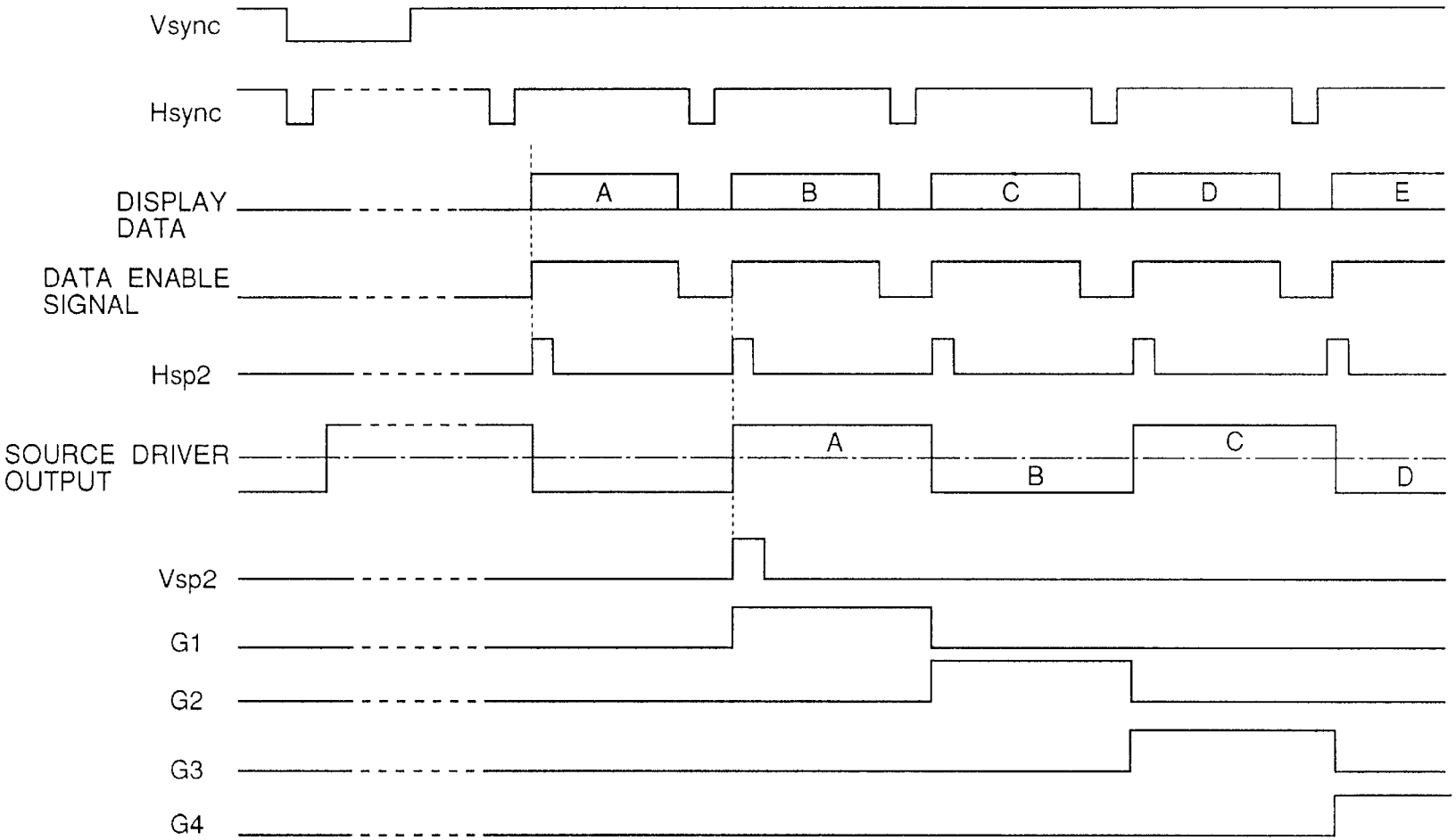
FIG.2B PRIOR ART
FIG. 2B is a timing chart for describing the operation of the display control mode of the active matrix liquid crystal display device.
Figure 3:
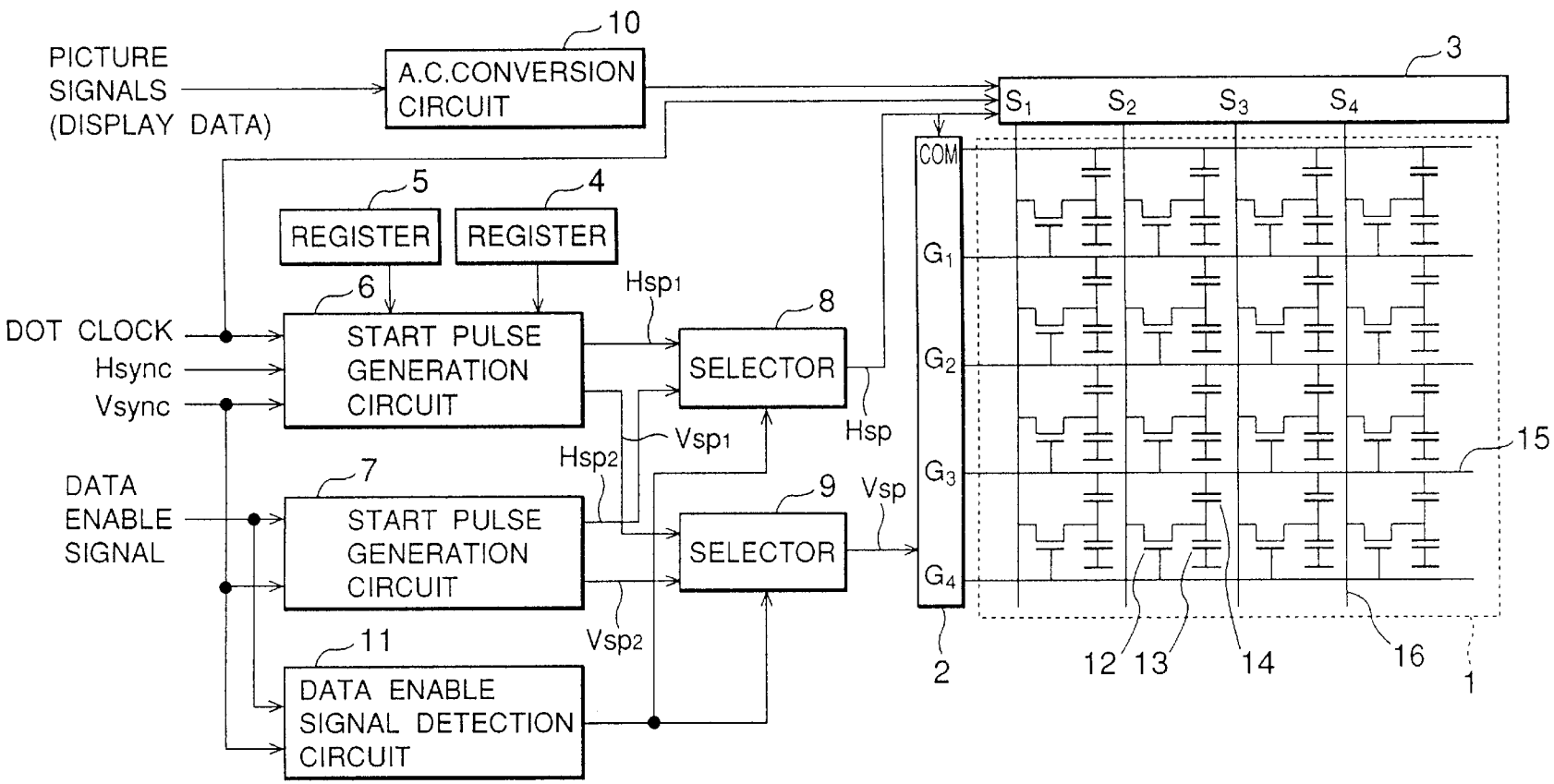
FIG. 3 is a block diagram showing the configuration of an embodiment of the active matrix liquid crystal display device according to this invention.

FIG. 3 schematically shows a configuration of an embodiment of the AM-LCDs according to this invention. In this figure, the configurations of the components corresponding to that of the conventional ones are given the same symbols as used in FIG. 1, and the same operations are assumed for the corresponding components.

The AM-LCD of this embodiment has a data enable signal detection circuit 11 generating the select signal inputted to the selectors 8 and 9.

The data enable signal detection circuit 11 receives the signal $V_{sync}$ and the data enable signal as inputs, generates a select signal on the basis of these signals, and outputs the generated select signal to the selectors 8 and 9. In this data enable signal detection circuit 11, if the data enable signal indicating the effective display data period is not detected for more than a constant period, a select signal is generated. For example, if the data enable signal indicating an effective display data period is not detected for a specific length of time or longer, the select signal goes to a first level (for example, a high level), and if the data enable signal indicating an effective display data period is detected within the specific length of time, the select signal goes to a second level (for example, a low level).

The operations of the display fixing mode and the display control mode according to this invention will be described next.

(1) Display Fixing Mode

The select signal to be inputted to the selectors 8 and 9 stays at a first level (e.g. high level) that indicates the data enable signal detection circuit 11 has not detected the data enable signal having the effective display data period. Therefore, the selectors 8 and 9 apply the signal $V_{sp1}$, and the signal $H_{sp1}$ that are generated by the start pulse generation circuit 6. These signals are inputted to the gate driver 2 and the source driver 3 respectively.

The source driver 3 starts to output the stored display data A, B, C, D, E, . . . in synchronism with the $H_{sp1}$ on receiving the signal $V_{sp1}$. At the same time, the gate driver 2 starts to output the scanning signal $G_1$, $G_2$, $G_3$, $G_4$, . . . sequentially to the gate lines in synchronism with the signal $H_{sp1}$. As a result, a whole including the display data A, B, C, D, E, . . . can be displayed in a specified position on the liquid crystal display panel 1.

(2) Display Control Mode

The select signal to be inputted to the selectors 8 and 9 keeps a second level (e.g. low level) that indicates the data enable signal detection circuit 11 has detected the data enable signal having the effective display data period. Therefore, the selectors 8 and 9 apply the signal $V_{sp2}$ and the signal $H_{sp2}$ that are generated by the start pulse generation circuit 6. These signals are inputted to the gate driver 2 and the source driver 3 respectively.

The source driver 3 starts to output the stored display data A, B, C, D, E, . . . , in synchronism with the signal $H_{sp2}$ on receiving the signal $V_{sp2}$. At the same time, the gate driver 2 starts to output the scanning signals $G_1$, $G_2$, $G_3$, $G_4$, . . . , sequentially to the gate lines in synchronism with the signal $H_{sp2}$. As a result, a whole image including the display data A, B, C, D, E, . . . are displayed in a desired position on the liquid crystal display panel 1. According to the above operations, it is possible to select one of two modes without a select signal from the outside.

A specific circuit configuration of the data enable signal detection circuit 11 will be described next.

Figure 4:
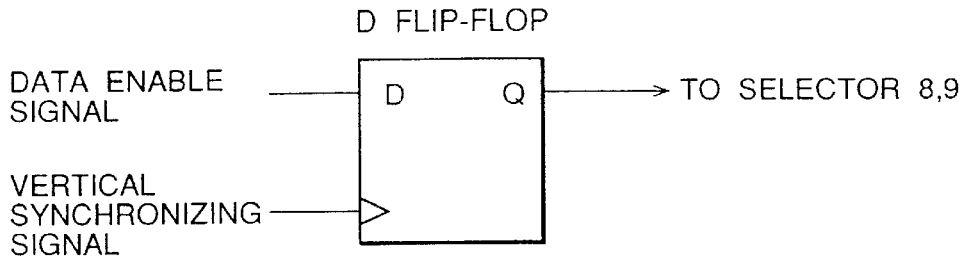
FIG. 4 is a diagram showing an example in which the data enable signal detection circuit of this invention comprises a D flip-flop.

FIG. 4 shows an example in which the data enable signal detection circuit 11 comprises a D flip-flop. As shown in FIG. 4, the data enable signal is inputted to the data input terminal, and the vertical synchronizing signal $V_{sync}$ from a external device such as a personal computer, to its clock input terminal. The vertical synchronizing signal $V_{sync}$ is used as a clock in the D flip-flop. The D flip-flop holds the level of the data enable signal at the rising (or falling) time of the vertical synchronizing signal and outputs the held level as a select signal to the selectors 8 and 9.

Figure 6A:
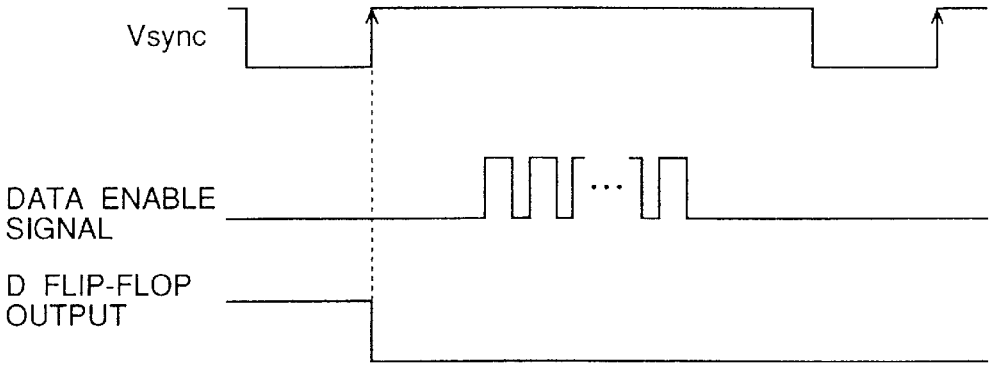
FIG. 6A is a timing chart for describing the operation of the D flip-flop.

In the case that the signals generated by the start pulse generating circuit 7 are selected, the select signal outputted by the D flip-flop, is at a low level. The data enable signal turns to the high level only during the effective display data period and keeps the low level for the rest of the time as shown in FIG. 6. The output of the D flip-flop results in the low level because the data enable signal is at the low level at the rising time of the vertical synchronizing signal. As a result, the selectors 8 and 9 select the signal $V_{sp2}$ and the signal $H_{sp2}$ that are generated by the start pulse generation circuit 7. These signals are inputted to the gate driver 2 and the source driver 3 respectively.

Figure 6B:
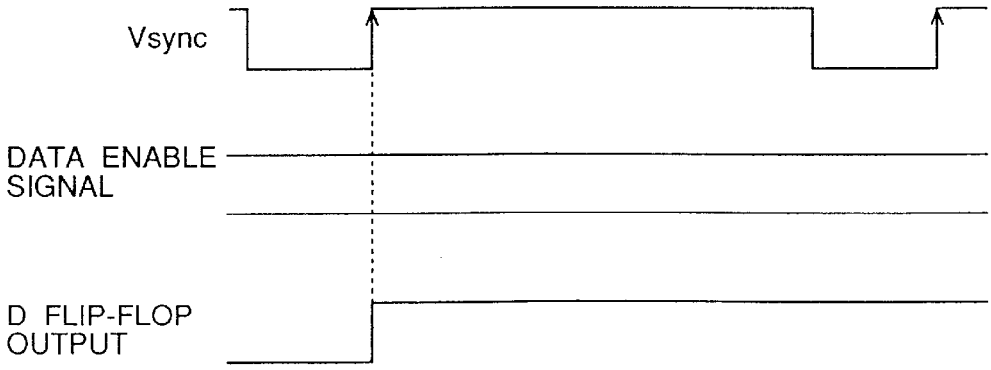
FIG. 6B is another timing chart for describing the operation of the D flip-flop.

On the other hand, in the case that the signals generated by the start pulse generating circuit 6 are selected, the select signal outputted by the D flip-flop, is at a high level. The data enable signal always stays at the high level as shown in FIG. 6B. The output of the D flip-flop results in the high level because the data enable signal is at the high level at the rising time of the vertical synchronizing signal. As a result, the selectors 8 and 9 select the signal $V_{sp1}$ and the signal $H_{sp1}$ that are generated by the start pulse generation circuit 6. These signals are inputted to the gate driver 2 and the source driver 3 respectively.

Figure 5:
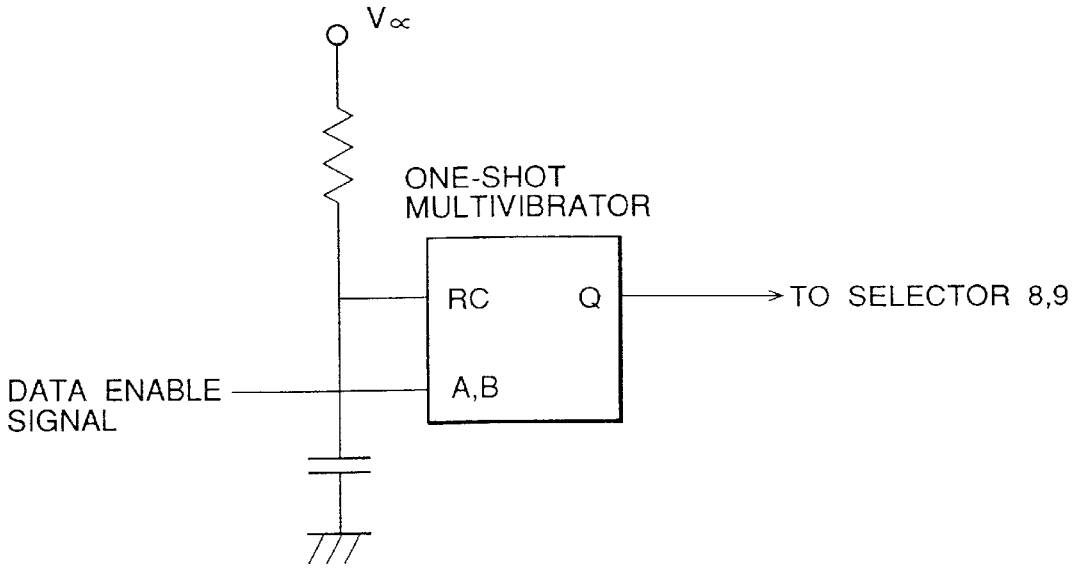
FIG. 5 is a diagram showing an example in which the data enable signal detection circuit of this invention comprises a one-shot multivibrator.

FIG. 5 shows an example in which the data enable signal detection circuit 11 comprising a one-shot multivibrator instead of a D flip-flop. The one-shot multivibrator uses the data enable signal as a clock signal, and attaches a circuit including a resistor and a capacitor that has a time constant longer than the cycle of the vertical synchronizing signal pulses.

With this constitution, while receiving the data enable signal that is at the high level during the effective display data period and at the low level for the rest of the time, the one-shot multivibrator is reset at the timing of every leading edge or every trailing edge of the data enable signal, and keeping the output a low level. As a result, the selectors 8 and 9 select the signal $V_{sp2}$ and the signal $H_{sp2}$ that are generated by the start pulse generating circuit 7. These signals are inputted to the gate driver 2 and the source driver 3 respectively.

However, if no pulse appears in the data enable signal for the time constant longer than the cycle of the vertical synchronizing signal pulses, then the one-shot multivibrator outputs a high level signal. As a result, the selectors 8 and 9 select the signal $V_{sp1}$ and the signal $H_{sp1}$ that are generated by the start pulse generating circuit 6. These signals are inputted to the gate driver 2 and the source driver 3 respectively. One-shot multivibrators having the above function named the $\mu$PD 74HC123A (Dual Retriggerable Monostable Multi-vibrator) are provided by NEC Corp.

In the embodiments presented above, the invention has been described in conjunction with an AM-LCD. However, the application of the present invention is not restrict to the AM-LCDS. The present invention is applicable also to any kind of display device as long as it has a constitution that can choose, in response to a select signal, between the first display mode (display fixing mode) which displays a received image (display data) in a specified position on the panel, and the second display mode (display control mode) which displays the received image in a desired position on the panel by using the data enable signal indicating the effective display period concerning the received image from the outside.

Besides, according to the present display device with the constitution, there is no need to modify any circuitry on the part of signal sources such as personal computers (not shown). Because it can apply the same timing signals as the conventional ones.

What is claimed is:

1. A liquid crystal display device, comprising:

a first generation circuit receiving at least one synchronization signal and generating a first control signal which controls a liquid crystal display panel, said first control signal including first information representative of a display area on said liquid crystal display panel based on said at least one synchronization signal;

a second generation circuit receiving a data enable signal and generating a second control signal which controls said liquid display panel, said data enable signal indicating an effective display data period, said second control signal including second information representative of a display area on said liquid crystal display panel based on said data enable signal;

a selector supplied with said first and second control signals and further with a selection signal, said selector selecting and outputting one of said first and second control signals in accordance with a state of said selection signal to control said liquid crystal display panel; and a control circuit which generates said selection signal based on said data enable signal and said synchronization signal, said control circuit controlling said state of said selection signal in reponse to said data enable signal.

2. The liquid crystal display device as claimed in claim 1, wherein said data enable signal is indicative of an effective display data period which keeps an enable level during said effective display data period, and keeps a desirable level during an invalid display data period.

3. A liquid crystal display device, comprising:

a first generation circuit receiving at least one synchronization signal and generating a first control signal which controls a liquid crystal display panel, said first control signal including first information representative of a display area on said liquid crystal panel based on said at least oen synchronization signal:

a second generation circuit receiving a data enable signal and generating a second control signal which controls said liquid display panel, said data enable signal indicating an effective display data period, said second control signal including second information representative of a display area on said liquid crystal display panel based on said data enable signal;

a selector supplied with said first and second control signals and further with a selection signal said selector selecting and outputting one of said first and second control signals in accordance with a state of said selection signal to control said liquid crystal display panel; and a control circuit which generates said selection signal and controls said state of said selection signal in response to said data enable signal, wherein said data enable signal is changed in logic level in order to indicate said effective display data period and is maintained at a predetermined logic level in order to indicate said effective display data period, said control circuit responding to said data enable signal being changed in logic level to control said state of said selection signal such that said selector selects and outputs said second control signal and responding to said data enable signal being maintained at said predetermined logic level to control said state of said selection signal such that said selector selects and outputs said first control signal.

4. The device as claimed in claim 3, wherein said first generation circuit receives a horizontal synchronization signal and a vertical synchronization signal to generate said first control circuit, and said control signal including a data latch circuit latching a logic level of said data enable signal in response to said vertical synchronization signal, an output of said data latch circuit being used as said selection signal.

5. The device as claimed in claim 3, wherein said control circuit includes a multivibrator, operation of said multivibrator being controlled by said data enable signal and an output of said multivibrator being used as said selection signal.

6. The device as claimed in claim 5, wherein said first generation circuit receives a horizontal synchronization signal and a vertical synchronization signal, and a cycle of the operation of said multivibrator is designed to be longer than a cycle of said vertical synchronization signal.

7. A liquid crystal display device operating in a selected one of first and second display modes, said first display mode being determined by horizontal and vertical synchronization signals and said second display mode being activated when a data enable signal appears and being controlled by said data enable signal, said device comprising:

a selector receiving a selection signal and selecting one of said first and second display modes in response to a state of said selection signal; and a detection circuit detecting an appearance of said data enable signal and controlling a state of said selection such that said selector selects said first display mode when said data enable signal is detected not to appear and selects said second display mode when said data enable signal is detected to appear, wherein said data enable signal is indicative of an effective display data period which keeps an enable level during said effective display data period, and keeps a desirable level during an invalid display data period.

8. A liquid crystal display device comprising:

a selector having a function of selecting a display mode to be performed from a plurality of display modes, said display modes including a first display mode controlled by a data enable signal indicative of an effective display data period and a second display mode independent from said data enable signal, and a detection circuit detecting whether or not said data enable signal appears and controlling said selector such that said selector selects said first display mode when said data enable signal is detected to appear and selects said second display mode when said data enable signal is detected not to appear, wherein said data enable signal is indicative of an effective display data period which keeps an enable level during said effective display data period, and keeps a desirable level during an invalid display data period.

* * * * *